US011497369B2

(12) United States Patent
Bosses

(10) Patent No.: US 11,497,369 B2
(45) Date of Patent: Nov. 15, 2022

(54) POWER SHARING VACUUM CLEANER ASSEMBLY

(71) Applicant: Zenith Technologies, LLC, Fort Lauderdale, FL (US)

(72) Inventor: Mark D Bosses, Boca Raton, FL (US)

(73) Assignee: ZENITH TECHNOLOGIES, LLC, Fort Lauderdale, FL (US)

( * ) Notice: Subject to any disclaimer, the term of this patent is extended or adjusted under 35 U.S.C. 154(b) by 333 days.

(21) Appl. No.: 16/834,266

(22) Filed: Mar. 30, 2020

(65) Prior Publication Data

US 2021/0204781 A1 Jul. 8, 2021

Related U.S. Application Data

(60) Provisional application No. 62/957,511, filed on Jan. 6, 2020.

(51) Int. Cl.

| | |
|---|---|
| ***A47L 9/28*** | (2006.01) |
| ***A47L 5/28*** | (2006.01) |
| ***A47L 5/22*** | (2006.01) |

(52) U.S. Cl.

CPC ..... *A47L 9/2878* (2013.01); *A47L 5/225* (2013.01); *A47L 5/28* (2013.01); *A47L 9/2805* (2013.01); *A47L 9/2836* (2013.01); *A47L 9/2873* (2013.01); *A47L 9/2884* (2013.01)

(58) Field of Classification Search

CPC ... A47L 5/225; A47L 5/26; A47L 5/28; A47L 5/30; A47L 9/2805; A47L 9/2836; A47L 9/2857; A47L 9/2873; A47L 9/2878; A47L 9/2884

See application file for complete search history.

(56) References Cited

U.S. PATENT DOCUMENTS

| | | | | |
|---|---|---|---|---|
| 8,997,311 | B2 * | 4/2015 | Huber | A47L 9/00 15/DIG. 1 |
| 9,472,979 | B2 * | 10/2016 | Mergener | H02J 7/34 |
| 2015/0320285 | A1 * | 11/2015 | Lee | A47L 9/2884 15/300.1 |
| 2016/0051109 | A1 * | 2/2016 | Hwang | A47L 5/28 15/339 |
| 2017/0196419 | A1 * | 7/2017 | Brown | A47L 7/00 |
| 2017/0319039 | A1 * | 11/2017 | Kim | A47L 5/225 |
| 2018/0271344 | A1 * | 9/2018 | Han | A47L 5/12 |
| 2019/0282055 | A1 | 9/2019 | Lee et al. | |
| 2020/0345196 | A1 * | 11/2020 | Innes | A47L 11/4025 |

FOREIGN PATENT DOCUMENTS

| | | | |
|---|---|---|---|
| JP | 2014200379 | A | 10/2014 |
| WO | WO-2020038423 | A1 * | 2/2020 |

OTHER PUBLICATIONS

The International Search Report and Written Opinion dated Apr. 6, 2021.

* cited by examiner

*Primary Examiner* — Marc Carlson

(74) *Attorney, Agent, or Firm* — Global IP Counselors, LLP

(57) ABSTRACT

A vacuum cleaner assembly basically includes a vacuum body, a first power source, an accessory, and a second power source. The first power source is configured to create flow through a suction path. The accessory is configured to be removably connected to the vacuum body. The second power source is configured to power the accessory. Each of the first and second power sources is configured to share power with the other of the first and second power sources.

14 Claims, 7 Drawing Sheets

POWER SHARING VACUUM CLEANER ASSEMBLY

CROSS-REFERENCE TO RELATED APPLICATIONS

This application claims the benefit under 35 U.S.C. § 119(e) of U.S. Provisional Application No. 62/957,511, filed Jan. 6, 2020. The entire disclosure of U.S. Provisional Application No. 62/957,511 is hereby incorporated herein by reference.

BACKGROUND

Field of the Invention

This invention generally relates to a power sharing vacuum cleaner assembly. More specifically, the present invention relates to a vacuum cleaner assembly having a vacuum body connected to a power head in which the vacuum body and the power head have separate power sources that are configured to share power with one another.

Background Information

A cordless vacuum cleaner has a single power source to create a suction path through a vacuum body of the vacuum cleaner. A plurality of accessories can be removably connectable to a vacuum body of the vacuum cleaner to provide a wide range of cleaning options. Some accessories, such as a powerhead, require power to operate. The charge level of the single power source of the vacuum cleaner is more quickly depleted when creating the suction path through the vacuum body and powering an accessory connected to the vacuum body.

SUMMARY

Generally, the present disclosure is directed to various features of a power sharing vacuum cleaner assembly.

In view of the state of the know technology and in accordance with a first aspect of the present disclosure, a vacuum cleaner assembly basically includes a vacuum body, a first power source, an accessory, and a second power source. The first power source is configured to create flow through a suction path. The accessory is configured to be removably connected to the vacuum body. The second power source is configured to power the accessory. Each of the first and second power sources is configured to share power with the other of the first and second power sources.

Another aspect of the present invention is to provide a vacuum cleaner charging assembly including a vacuum cleaner assembly and a charging stand. The vacuum cleaner assembly includes a vacuum body, a first power source, an accessory and a second power source. The first power source is removably disposed in the vacuum body and is configured to create flow through a suction path. The accessory is configured to be removably connected to the vacuum body. The second power source is removably disposed in the accessory and is configured to power the accessory. The charging stand is configured to removably receive the vacuum body and the accessory. The charging stand is configured to charge the first and second power sources when the vacuum body and the accessory are received by the stand. Each of the first and second power sources is configured to share power with the other of the first and second power sources.

Also, other objects, features, aspects and advantages of the disclosed power sharing vacuum cleaner assembly will become apparent to those skilled in the art from the following detailed description, which, taken in conjunction with the annexed drawings, discloses several embodiments of a power sharing vacuum cleaner assembly.

BRIEF DESCRIPTION OF THE DRAWINGS

Referring now to the attached drawings which form a part of this original disclosure.

Throughout the drawing figures, like reference numerals will be understood to refer to like parts, components and structures.

DETAILED DESCRIPTION OF EXEMPLARY EMBODIMENTS

Selected exemplary embodiments will now be explained with reference to the drawings. It will be apparent to those skilled in the art from this disclosure that the following descriptions of the exemplary embodiments are provided for illustration only and not for the purpose of limiting the invention as defined by the appended claims and their equivalents.

As shown in FIGS. 1-5, a power sharing vacuum cleaner assembly 10 in accordance with an exemplary embodiment of the present invention includes a vacuum body 12 and an accessory 14. The accessory 14 is removably connected to the vacuum body 12. The vacuum cleaner assembly 12 can be any suitable type of vacuum cleaner, such as, but not limited to, a cordless stick vacuum cleaner. The various components and interactions of the vacuum cleaner assembly 10 would be understood by one of ordinary skill in the art.

Figure 1:
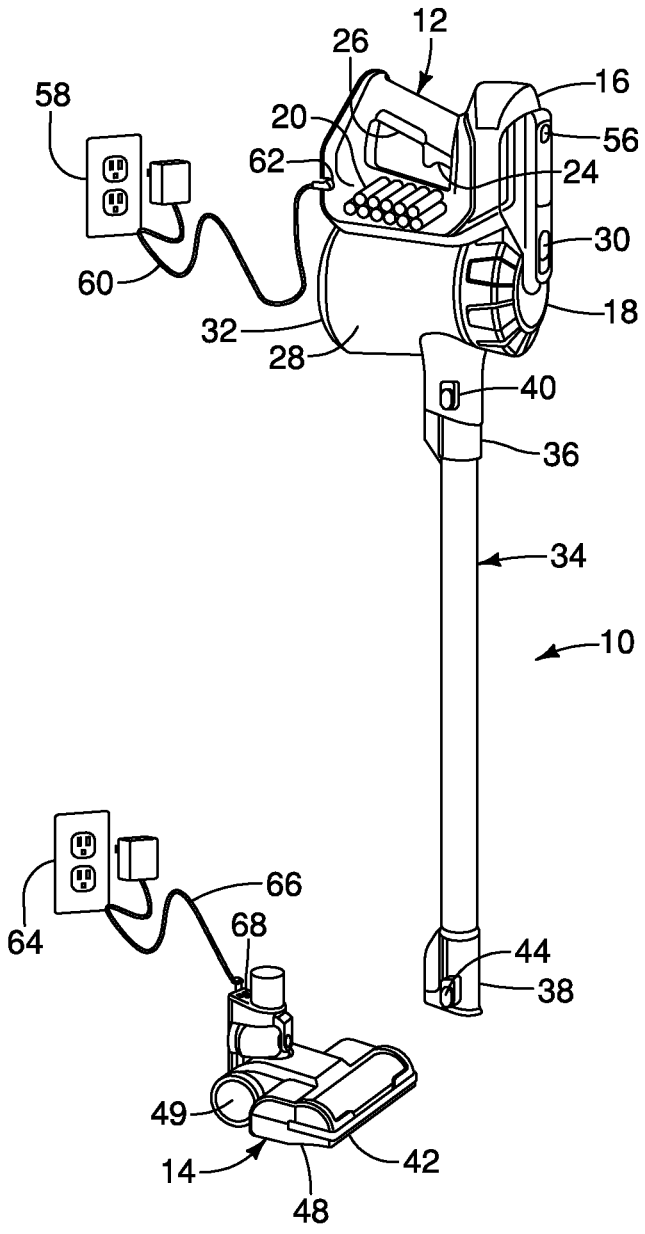
FIG. 1 is an exploded assembly view of a power sharing vacuum cleaner assembly in accordance with an exemplary embodiment of the present invention.
Figure 3:
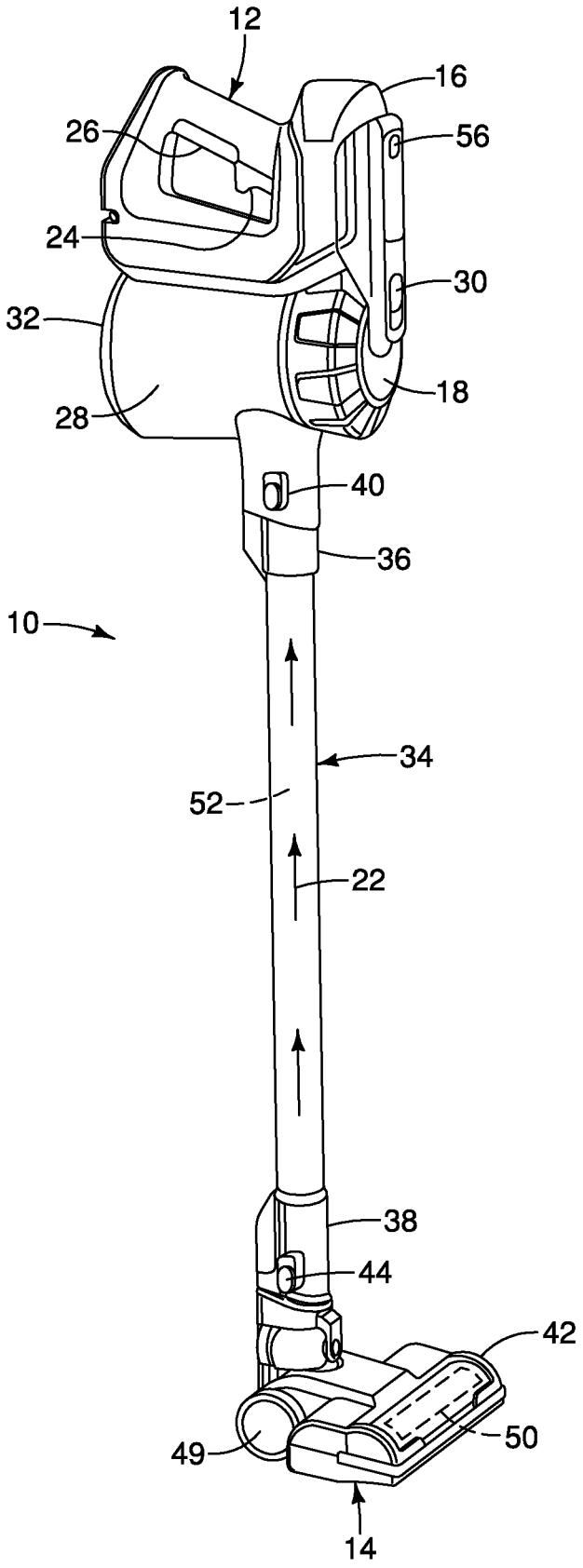
FIG. 3 is a perspective view of an assembled vacuum cleaner assembly of FIG. 1.
Figure 6:
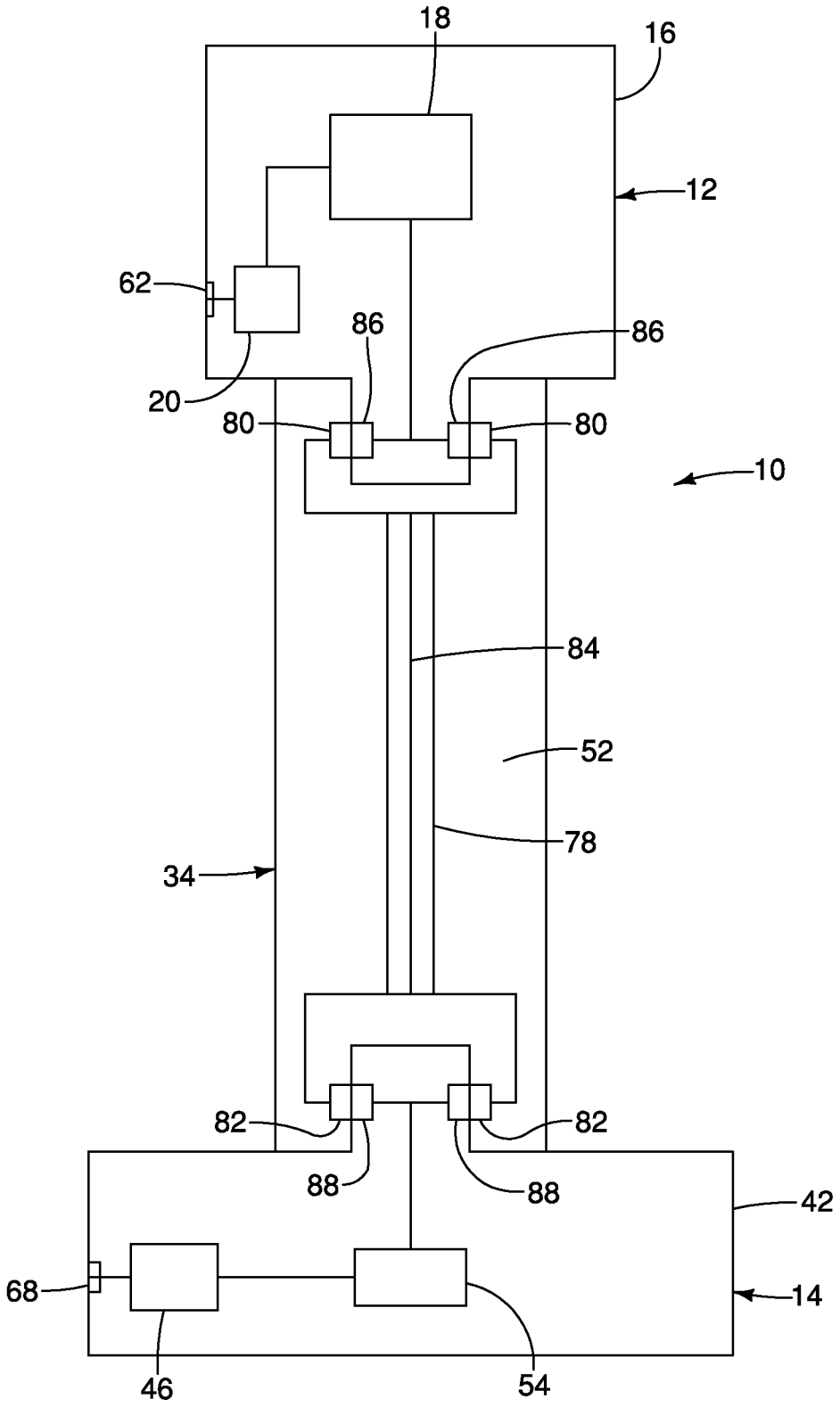
FIG. 6 is a diagram of an electrical path in the vacuum cleaner assembly of FIG. 3.

The vacuum body 12 includes a housing 16 in which a suction motor 18 and a first power source 20 are disposed, as shown in FIGS. 1 and 6. The first power source 20, such as a plurality of rechargeable batteries or a rechargeable battery pack, is electrically connected to and powers the motor 18, which creates a suction flow path 22, as shown in FIG. 3. A power button 24 disposed on the housing 16 turns on and off the power supply of the first power source 20 to the motor 18. The housing 16 includes a gripping portion 26 to facilitate handling the vacuum cleaner assembly 10. The first power source 20 is preferably removably disposed in the vacuum body 12.

The housing 16 further includes a dust bin 28 configured to receive dirt and other debris collected during operation of the vacuum cleaner assembly 10. Alternatively, the dust bin 28 can be removably connected to the housing 16. The suction path 22 flows into and through the dust bin 28, thereby trapping dust, dirt and other debris carried through the suction path 22 inside the dust bin 28. A release button 30 disposed on the housing 16 can be operated to open a cover 32 of the bust bin 28 to discard the contents of the dust bin 28. Alternatively, the dust bin 28 can be removed from the housing 16 to discard the contents thereof, and the dust bin can then be reconnected to the housing.

The suction motor 18 of the vacuum cleaner assembly 10 creates flow through the suction path 22, as shown in FIG. 3. The suction path 22 extends from a suction inlet of the accessory 14 to the dust bin 28. The suction path 22 flows into and through the dust bin 28, thereby trapping dust, dirt and other debris carried through the suction path 22 inside the dust bin 28. The suction path 22 exits the housing 16 through vents disposed therein.

A suction wand 34 is removably connected to the vacuum body 12. The suction wand 34 has a first end 26 and a second end 38. The first end 36 of the suction wand 34 is connected to the vacuum body 12. The suction wand 34 is removably connected to the vacuum body 12 in any suitable manner, such as a snap fit connection, that facilitates connecting the suction wand 34 to and removing the suction wand 34 from the vacuum body 12. A release button 40 on the vacuum body 12 releases the connection between the suction wand 34 and the vacuum body 12 such that the suction wand 34 can be removed from the vacuum body 12. Alternatively, the release button 40 can be disposed on the suction wand 34. The accessory 14 can be received by the vacuum body 16 when the suction wand 34 is not connected to the vacuum body 16.

A second end 38 of the suction wand 34 is configured to receive the accessory 14, such as a powerhead 42. The accessory 14 is removably connected to the suction wand 34 in any suitable manner, such as a snap fit connection, that facilitates connecting the accessory 14 to and removing the accessory 14 from the suction wand 34. A release button 44 on the suction wand 34 releases the connection between the accessory 14 and the suction wand 34 such that the accessory 14 can be removed. Alternatively, the release button 44 can be disposed on the accessory 14.

Figure 2:
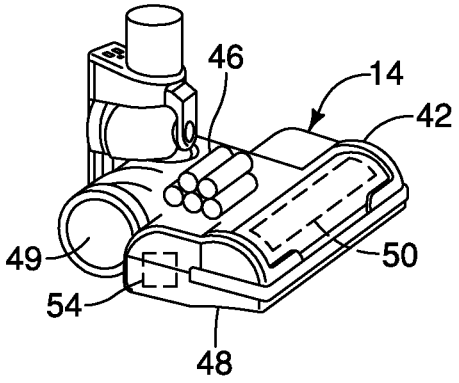
FIG. 2 is a perspective view of a powerhead configured to be removably connected to a vacuum body of the vacuum cleaner assembly of FIG. 1.

The accessory 14, such as the powerhead 42, is removably connected to the suction wand 34 to provide alternative cleaning options, as shown in FIGS. 1 and 3. Alternatively, the accessory 14 can be directly removably connected to the vacuum body 12. The accessory 14 has a second power source 46, as shown in FIG. 2, configured to supply power to the accessory 14. The accessory 14 is shown as a powerhead 42, although the accessory 14 can be any suitable power tool having an internal power source.

As shown in FIG. 2, the powerhead 42 includes the second power source 46 disposed within a housing 48. The second power source 42 is preferably a plurality of rechargeable batteries or a rechargeable battery pack, although any suitable power source can be used. The second power source 46 is preferably removably disposed in the accessory 14.

The powerhead 42 includes a plurality of wheels 49 rotatably connected to the housing 48 to facilitate pushing and pulling the vacuum cleaner assembly 10 during operation. A surface agitator 50, such as a brush roll, is movably disposed in the housing 48. A suction inlet is disposed in a bottom surface of the housing 48 in association with the surface agitator 50. The suction path 22 extends from the suction inlet in the bottom surface of the housing 48, through a passage 52 in the suction wand 34 to the dust bin 28, as shown in FIG. 3.

A motor 54 is disposed in the housing 48 of the powerhead 42, as shown in FIGS. 2 and 6. The motor 54 is electrically connected to the second power source 46. The motor 54 drives the surface agitator 50. The motor 54 is configured to be powered by the second power source 46. A power button 56 disposed on the vacuum body housing 16 turns on and off the supply of power from the second power source 46 to the powerhead motor 54.

When the powerhead 42 is connected to the second end 38 of the suction wand 34, the suction path 22 extends from the suction inlet in the housing 48 of the powerhead 42, through the suction wand 34, through the housing 16 of the vacuum body 12, and to the dust bin 28, as shown in FIG. 2. The suction path 22 continues through the dust bin 28 back into the vacuum body housing 16. The air flowing through the vacuum body housing 16 is then vented to the atmosphere through vents in the vacuum body housing 16. The dust bin 28 is configured to trap dust and other debris carried though the suction path 22 to the dust bin 28.

The first power source 20 is configured to generate flow through the suction path 22. The first power source 20 is disposed in the vacuum body housing 16 and is configured to be connected to an external power supply 58, such as an electrical outlet, to charge the first power source 20, as shown in FIG. 1. A power cord 60 is connected between a port 62 in the vacuum body housing 16 and the external power supply 58 to supply power from the external power supply 58 through the power cord 60 to charge the first power source 20, as shown in FIGS. 1 and 6. The port 62 is electrically connected to the first power source 20. The power cord 60 is removed from the port 62 and the external power supply 58 when the first power source is charged to a desired level. An indicator can be disposed on the vacuum body housing 16 to indicate when the first power source 20 is fully charged.

The second power source 46 is configured to power the powerhead 42. The second power source 46 is disposed in the powerhead housing 48 and is configured to be connected to an external power supply 64, such as an electrical outlet, to charge the second power source 46, as shown in FIG. 1. A power cord 66 is connected between a port 68 in the powerhead housing 52 and the external power supply 64 to supply power from the external power supply 64 through the power cord 66 to charge the second power source 46. The port 68 is electrically connected to the second power source 46. The power cord 66 is removed from the port 68 and the external power supply 64 when the second power source 46 is charged to a desired level. An indicator can be disposed on the powerhead housing 42 to indicate when the second power source 46 is fully charged. The power cords 60 and 66 allow the first and second power sources 20 and 46 to be independently charged. Alternatively, a single power cord can be connected to one of the ports 62 and 68 to simultaneously charge both the first and second power sources 20 and 46 when the accessory 14 is connected to the vacuum body 12.

Figure 4:
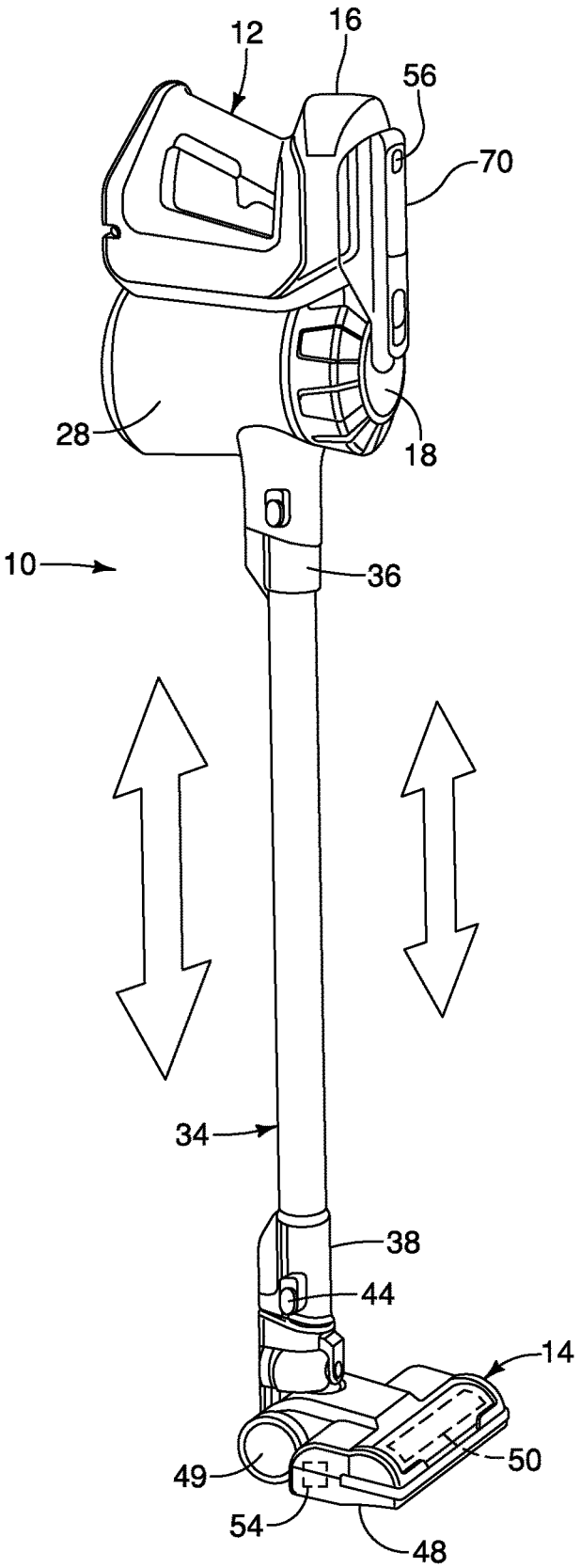
FIG. 4 is a perspective view of the assembled vacuum cleaner assembly of FIG. 1 illustrating power sharing of first and second power sources.

By disposing the second power source 46 in the accessory 14, the weight of the vacuum cleaner assembly 10 is more evenly distributed. The weight of the second power source 46 disposed in the accessory 14 is proximal to the floor, such that the weight of the second power source 46 is spaced from the first power source 20, which is disposed in the body housing 16 spaced farther from the floor than the second power source 46. The second power source 46 is spaced from the first power source 20 by at least a length of the suction wand 34, as shown in FIGS. 4 and 6. In other words, the suction wand 34 is disposed between the first power source 20 and the second power source 46.

An electrical conduit 78 extends through the passage 52 in the suction wand 34, such that mechanically connecting the suction wand 34 to the vacuum body 12 and to the accessory 14 also electrically connects the vacuum body 12 and the accessory 14. The first and second ends 36 and 38 of the suction wand 34 have electrical contacts 80 and 82, respectively, electrically connected to electrical wiring 84 extending through the conduit 78. The electrical contacts 80 and 82 mate with corresponding electrical contacts 86 and 88 disposed in the vacuum body housing 16 and the powerhead housing 48, respectively. The electrical contacts 86 and 88 disposed in the vacuum body housing 16 and the powerhead housing 48 are electrically connected to the first and second power sources 20 and 46, respectively. An electrical path extends between the first power source 20 and the second power source 46 such that electrical power can be shared therebetween. The electrical path extends from the first power source 20 to the engaged electrical contacts 86 and 80 in the vacuum body housing 16 and the first end 36 of the suction wand 34, through the wiring 84 disposed in the conduit 78 in the suction wand 34, to the engaged electrical contacts 82 and 88 in the second end 38 of the suction wand 34 and the powerhead housing 48, and to the second power source 54.

During operation of the vacuum cleaner assembly 10, the first power source 20 powers the suction motor 18 and the second power source 46 powers the powerhead motor 54. When a power level of the second power source 46 falls below a second predetermined level, electrical power is supplied from the first power source 20 through the electrical path to the second power source 46 to maintain operation of the powerhead motor 54, thereby extending the operation time of the vacuum cleaner assembly 10. When a power level of the first power source 20 falls below a first predetermined level, electrical power is supplied from the second power source 46 through the electrical path to the first power source 20 to maintain operation of the suction motor 18, thereby extending the operation time of the vacuum cleaner assembly 10. As shown in FIG. 4, power can be shared in either direction between the first and second power 20 and 46. The first and second predetermined power levels can be any suitable power level, such as sharing being initiated when one of the power sources is at or below five percent of the charge remaining. Alternatively, the first and second predetermined charge levels are different such that one power source receives power at a different remaining charge than the other power source.

A controller is disposed in the vacuum body housing 16 and is electrically connected to the electrical path. The controller monitors the charge levels of the first and second power sources 20 and 46. Upon detecting that one of the first and second power sources 20 and 46 falls below a second predetermined level, the controller causes electrical power to be supplied from the other of the first and second power sources 20 and 46 to the power source detected to be below the predetermined level. The first and second predetermined levels can be the same, or can be different.

Figure 5:
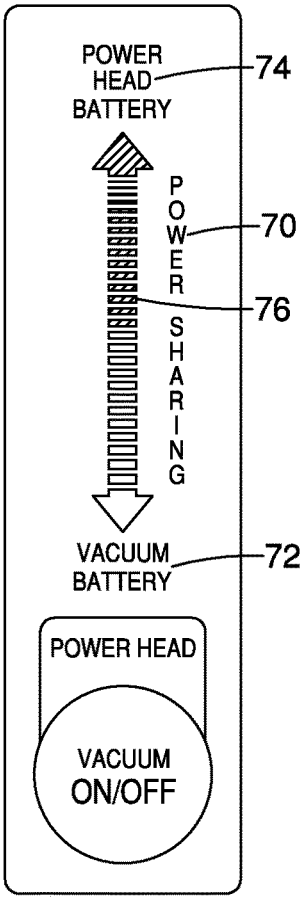
FIG. 5 is a front elevational view of a control panel disposed on the vacuum body of the vacuum cleaner assembly of FIG. 4.

A display panel 70 is disposed on the vacuum body housing 16, as shown in FIGS. 4 and 5. The display panel 70 includes an indication 72 for the vacuum battery at one end and an indication 74 for the powerhead battery at an opposite end. A power sharing meter 76 extends between the vacuum battery indication 72 and the powerhead battery indication 74 and is illuminated to indicate when electrical power is shared between the first and second power sources 20 and 46 and to indicate in which direction electrical power is being shared. As shown in FIG. 5, electrical power is being shared from the powerhead battery, or the second power source, to the vacuum battery, or the first power source. Sharing electrical power between the first and second power sources 20 and 46 prolongs the operation time of the vacuum cleaner assembly 10, as electrical power from a sufficiently charged power source can be shared with a depleted power source.

Figure 7:
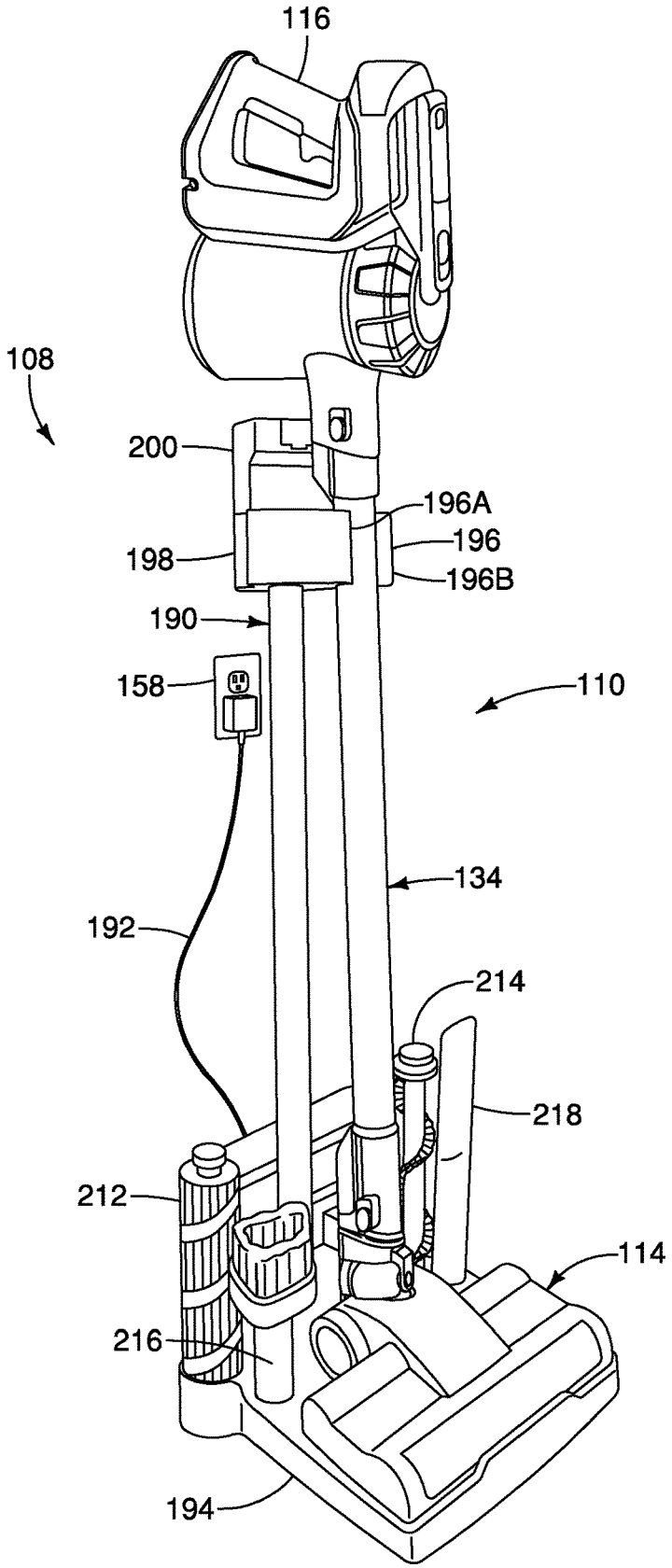
FIG. 7 is a perspective view of a vacuum cleaner assembly connected to a charging stand in accordance with another exemplary embodiment of the present invention.
Figure 8:
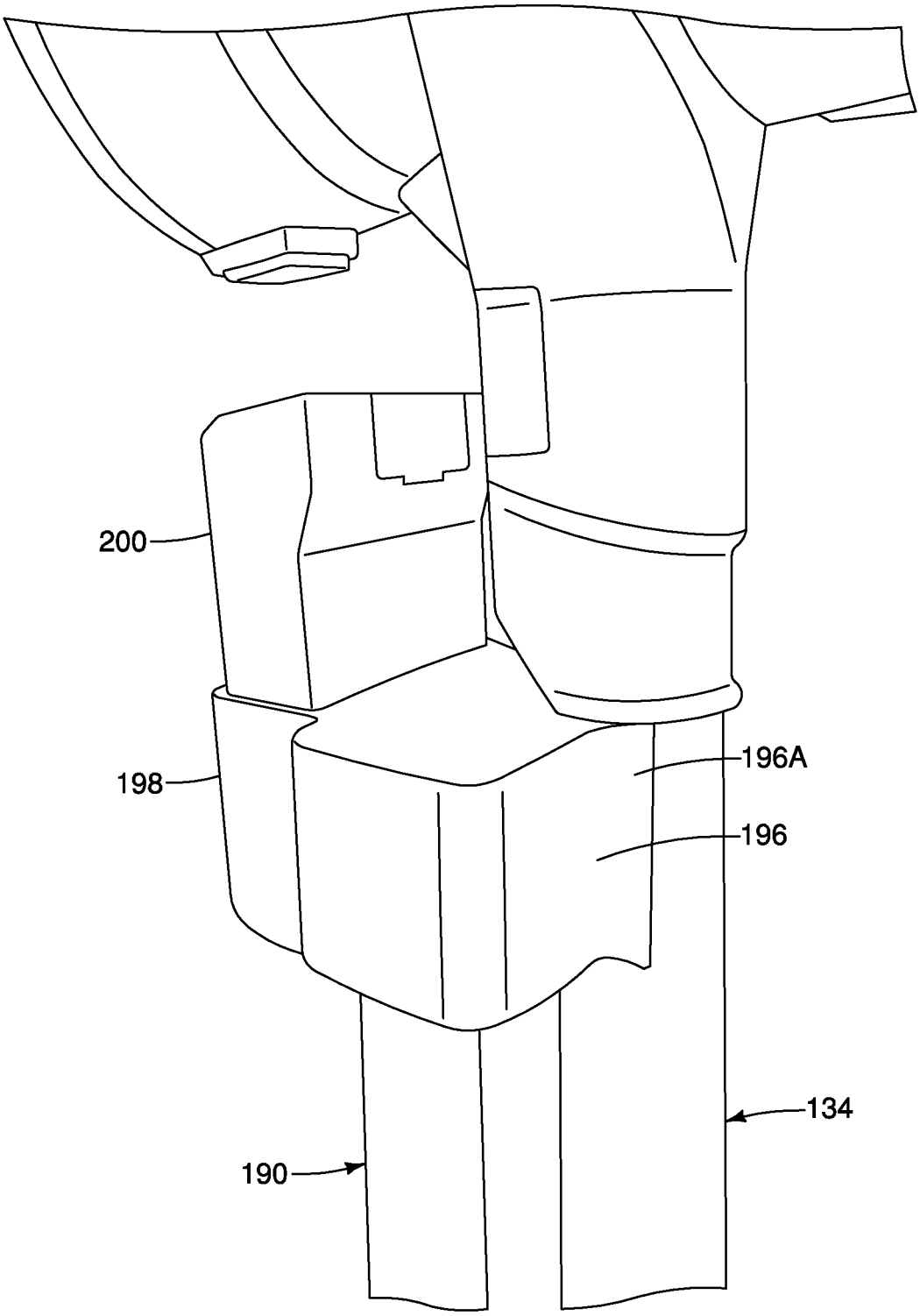
FIG. 8 is an enlarged perspective view of the vacuum cleaner assembly and charging stand of FIG. 7 illustrating a charging receptacle for a battery.
Figure 9:
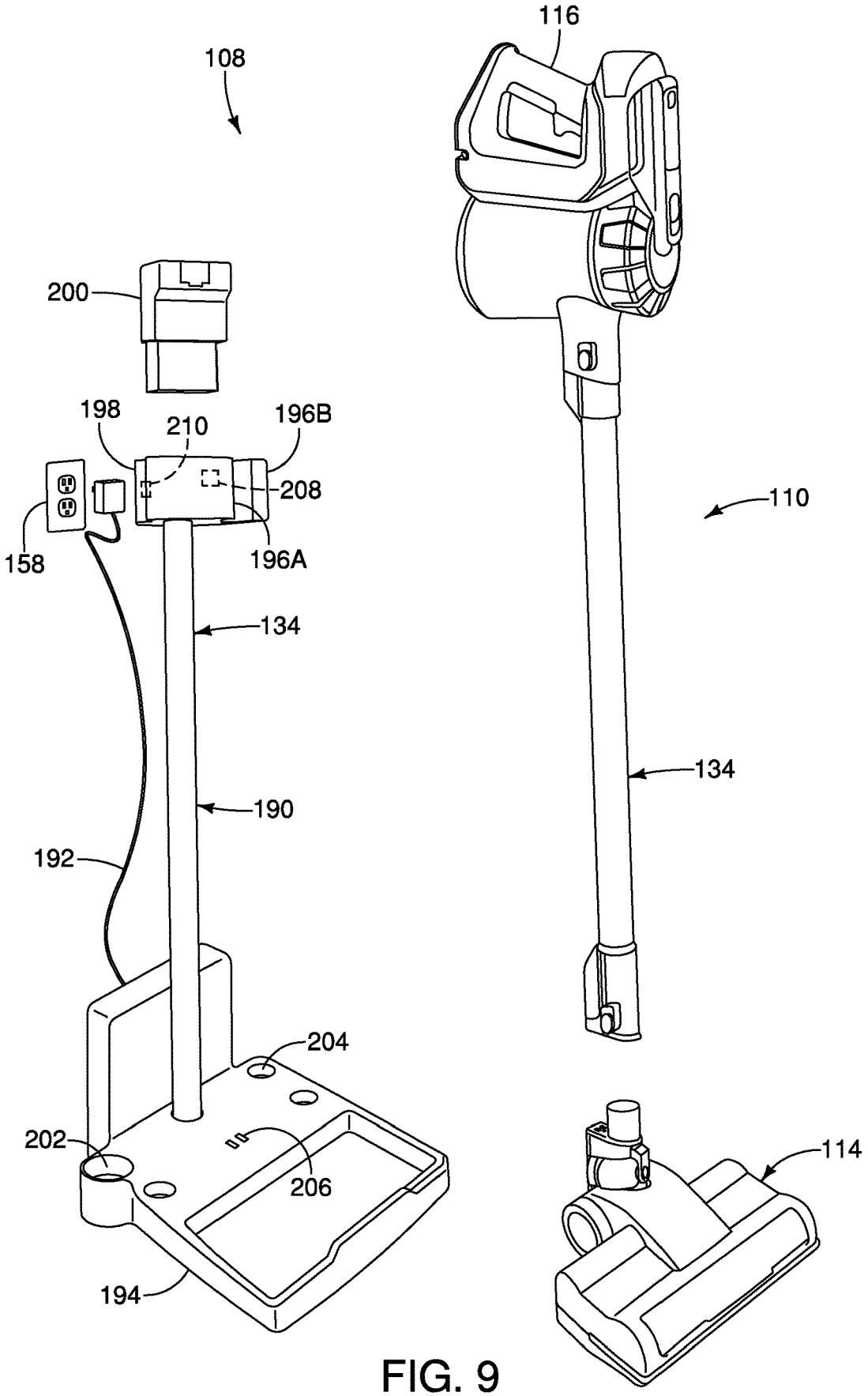
FIG. 9 is an exploded assembly view of the vacuum cleaner assembly and the charging stand of FIG. 7.

As shown in FIGS. 7-9, a vacuum cleaner assembly 110 in accordance with another illustrated exemplary embodiment of the present invention is substantially similar to the vacuum cleaner assembly 10 of the exemplary embodiment illustrated in FIGS. 1 to 6 except for the differences described below. Similar parts are identified with similar reference numerals, except increased by 100 (i.e., 1*xx*, accordingly).

A vacuum cleaner charging assembly 108, as shown in FIGS. 7 and 9, includes the vacuum cleaner assembly 110 and a charging stand 190. The first and second power sources of the vacuum cleaner assembly 110 are charged through the charging stand 190, as shown in FIGS. 7-9. The stand 190 includes a power cord 192 removably connectable to the external power supply 158 to supply electrical power from the external power supply 158 to the stand 190. The stand 190 includes a base 194 for removably receiving the powerhead 114, a suction wand receiver 196 for removably receiving the suction wand 134, and a battery receptacle 198 for removably receiving a battery pack 200 (i.e., a third power source).

The base 194 of the stand 190 removably receives the powerhead 114 of the vacuum cleaner assembly 110, as shown in FIGS. 7 and 9. The power cord 192 extends from the base 194 and is removably connectable to the external power source 158 to supply power to the stand 190. The base 194 includes a plurality of openings 202 and 204 to removably receive a plurality of accessories removably connectable to the vacuum cleaner assembly 110. As shown in FIG. 9, the openings 202 and 204 can be different sizes to accommodate various sized accessories. The accessories can include, but are not limited to, brush rolls 212 and 214, dust brushes 216, and crevice tools 218.

The base 194 includes an electrical contact 206 that is engaged by a corresponding electrical contact on the powerhead 114 to charge the second power source 46 (FIG. 6) disposed in the powerhead 114 when the stand 190 is connected to the external power supply 158, as shown in FIG. 7. The electrical contact 206 can be disposed in any suitable position of the base 194 that is contacted by the powerhead 114 when the powerhead 114 is received by the base 194 of the stand 190.

The suction wand receiver 196 removably receives the suction wand 134 of the vacuum cleaner assembly 110, as shown in FIGS. 7-9. The suction wand receiver 196, as shown in FIG. 7, includes a pair of outwardly extending flexible tabs 196A and 196B. The tabs 196A and 196B are spaced apart by a distance less than the diameter of the suction wand 134, such that the tabs 196A and 196B flex outwardly to receive the suction wand 134 of the vacuum cleaner assembly 110. The tabs 196A and 196B return to their original position to securely retain the suction wand 134 to the suction wand receiver 196 of the base 190.

The suction wand receiver 196 includes an electrical contact 208 that is engaged by a corresponding electrical contact on the suction wand 134 to charge the first power source 20 disposed in the housing 16 (FIG. 1) when the stand 190 is connected to the external power supply 158, as shown in FIG. 7. The electrical contact 208 can be disposed in any suitable position of the suction wand receiver 196 that is contacted by the suction wand 134 when the suction wand 134 is received by the suction wand receiver 196 of the stand 190.

The battery receptacle 198 has a vertically oriented opening for receiving a battery pack 200, as shown in FIGS. 7-9. The battery receptacle 198 includes an electrical contact 210 that is engaged by a corresponding electrical contact on the battery pack 200 to charge the battery pack 200 when the stand 190 is connected to the external power supply 158, as shown in FIG. 7. The electrical contact 210 can be disposed in any suitable position of the battery receptacle 198 that is contacted by the battery pack 200 when the battery pack 200 is received by the battery receptacle 198 of the stand 190. Accordingly, the battery pack 200 can replace one of the first and second power sources 20 and 46 connected to the housing 116 or the powerhead 114 of the vacuum cleaner assembly 110. The first and second power sources 20 and 46 can be identical battery packs, such that the battery pack 200 can be used to replace either the first or second power sources when depleted. Alternatively, the first and second power sources 20 and 46 can be different, and the third power source 200 can be identical to one of the first and second power sources 20 and 46 to replace that power source when depleted. Although the charging stand 190 is shown with one battery receptacle 198, the charging stand 198 can include additional battery receptacles such that a plurality of battery packs can be simultaneously charged and stored.

Each of the electrical contacts 206, 208 and 210 is electrically connected to the power cord 192. Electrical power is supplied to each of the electrical contacts 206, 208 and 210 when the power cord 192 of the stand 190 is connected to the external power source 158, as shown in FIG. 7. The stand 190 simultaneously receives the suction wand 134, the powerhead 114 and the battery pack 200 such that the suction wand 134, the powerhead 114 and the battery pack 200 can be simultaneously charged. The battery pack, or the third power source), 200 can be charged when the vacuum cleaner assembly 110 is in operation and not connected to the charging stand 190.

The foregoing detailed description of the certain exemplary embodiments has been provided for the purpose of explaining the principles of the invention and its practical application, thereby enabling others skilled in the art to understand the invention for various exemplary embodiments and with various modifications as are suited to the particular use contemplated. This description is not necessarily intended to be exhaustive or to limit the invention to the exemplary embodiments disclosed. Any of the exemplary embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "forward", "rearward", "front", "rear", "up", "down", "above", "upper", "below", "lower", "upward", "upwardly", "downward", "downwardly", "top", "bottom", "side", "vertical", "horizontal", "perpendicular" and "transverse" as well as any other similar directional terms refer to those directions of a vacuum cleaner assembly in an upright position for use. Accordingly, these directional terms, as utilized to describe the vacuum cleaner assembly should be interpreted relative to a vacuum cleaner in an upright position on a horizontal surface. The terms "left" and "right" are used to indicate the "right" when referencing from the right side as viewed from the rear of the vacuum cleaner assembly, and the "left" when referencing from the left side as viewed from the rear of the vacuum cleaner assembly.

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the exemplary embodiments according to the present invention are provided for illustration only, and not for the purpose of limiting the invention as defined by the appended claims and their equivalents.

What is claimed is:

1. A vacuum cleaner assembly, comprising:

a vacuum body;

a first power source configured to create flow through a suction path;

an accessory configured to be removably connected to the vacuum body; and a second power source disposed in the accessory, each of the first and second power sources being configured to share power with the other of the first and second power sources, the first power source being configured to share power with the second power source when the second power source is below a second predetermined charge level, and the second power source being configured to share power with the first power source when the first power source is below a first predetermined charge level.

2. The vacuum cleaner assembly according to claim 1, wherein the accessory is a powerhead.

3. The vacuum cleaner assembly according to claim 1, wherein the first power source is disposed in the vacuum body, and the second power source is configured to power the accessory.

4. The vacuum cleaner assembly according to claim 3, wherein each of the first and second power sources is a rechargeable battery.

5. The vacuum cleaner assembly according to claim 1, wherein the first and second power predetermined charge levels are different.

6. The vacuum cleaner assembly according to claim 1, wherein the first and second power sources are configured to be independently charged.

7. The vacuum cleaner assembly according to claim 1, wherein the vacuum body includes a suction wand, the suction wand being disposed between the first power source and the second power source.

8. A vacuum cleaner charging assembly, comprising:

a vacuum cleaner assembly including a vacuum body;

a first power source disposed in the vacuum body and configured to create flow through a suction path;

an accessory configured to be removably connected to the vacuum body; and a second power source disposed in the accessory and configured to power the accessory;

each of the first and second power sources being configured to share power with the other of the first and second power sources; and a charging stand configured to removably receive the vacuum body and the accessory, the charging stand being configured to charge the first and second power sources when the vacuum body and the accessory are received by the stand, the first power source being configured to share power with the second power source when the second power source is below a second predetermined charge level, and the second power source being configured to share power with the first power source when the first power source is below a first predetermined charge level.

9. The vacuum cleaner charging assembly according to claim 8, wherein the first power source is removably disposed in the vacuum body, and the second power source is removably disposed in the accessory.

10. The vacuum cleaner charging assembly according to claim 9, wherein a third power source is configured to be received by a receptacle in the charging stand.

11. The vacuum cleaner charging assembly according to claim 10, wherein each of the first, second and third power sources is a rechargeable battery.

12. The vacuum cleaner charging assembly according to claim 11, wherein the charging stand is configured to charge the third power source when the third power source is received by the receptacle.

13. The vacuum cleaner charging assembly according to claim 12, wherein the charging stand is configured to simultaneously charge the first power source, the second power source and the third power source.

14. The vacuum cleaner charging assembly according to claim 12, wherein the charging stand is configured to charge the third power source when the vacuum cleaner assembly is not connected to the charging stand.

* * * * *